US007363955B2

(12) United States Patent
Hindhede et al.

(10) Patent No.: US 7,363,955 B2
(45) Date of Patent: Apr. 29, 2008

(54) VENETIAN BLIND

(75) Inventors: Per Solso Hindhede, Skjern (DK); Knud Erik Hansen-Vestkær, Ølgod (DK)

(73) Assignee: VKR Holding A/S, Hoersholm (DK)

( * ) Notice: Subject to any disclaimer, the term of this patent is extended or adjusted under 35 U.S.C. 154(b) by 236 days.

(21) Appl. No.: 10/542,979

(22) PCT Filed: Jan. 27, 2004

(86) PCT No.: PCT/DK2004/000056

§ 371 (c)(1),
(2), (4) Date: Jul. 21, 2005

(87) PCT Pub. No.: WO2004/067893

PCT Pub. Date: Aug. 12, 2004

(65) Prior Publication Data

US 2006/0124253 A1 Jun. 15, 2006

(30) Foreign Application Priority Data

Jan. 28, 2003 (DK) ..... 2003 00107

(51) Int. Cl.
*E06B 9/307* (2006.01)

(52) U.S. Cl. ..... 160/176.1 R; 160/177 R

(58) Field of Classification Search ..... 160/176.1 R, 160/177 R, 178.3
See application file for complete search history.

(56) References Cited

U.S. PATENT DOCUMENTS 2,113,933 A * 4/1938 Darling ..... 160/176.1 R
2,209,234 A 7/1940 Nardulli
3,289,739 A * 12/1966 Hensel ..... 160/178.1 R
3,333,905 A 8/1967 Hennequin
4,416,320 A * 11/1983 Nordin ..... 160/177 R
4,821,789 A * 4/1989 Van Rens ..... 160/176.1 R
5,123,472 A * 6/1992 Nagashima et al. ..... 160/170
5,267,598 A * 12/1993 Marocco ..... 160/177 R
5,285,838 A * 2/1994 Rapp et al. ..... 160/168.1 R
6,279,642 B1 8/2001 Liu
6,792,997 B2 * 9/2004 Damiano ..... 160/178.1 R

FOREIGN PATENT DOCUMENTS

CH 429108 7/1967
EP 0098333 1/1984

* cited by examiner

*Primary Examiner*—Blair M. Johnson
(74) *Attorney, Agent, or Firm*—Merek, Blackmon & Voorhees, LLC

(57) ABSTRACT

A Venetian blind (1) with at least two vertically expanding ladder members (3). Each ladder member (3) comprises at least one vertical member (4), which by means of a plurality of vertically spaced ladder rungs (5, 11) is connected to at least one other vertical member (4). The Venetian blind further comprises a plurality of horizontally arranged cross slats (6) each being supported on each of the ladder members (3) by at least one of the ladder rungs (5) between the two vertical members (4). Each of the at least two ladder members (3) is carried in at least one of their ladder rungs (5, 11) by at least one carrier member.

11 Claims, 2 Drawing Sheets

VENETIAN BLIND

CROSS-REFERENCE TO RELATED APPLICATION

Figure 1:
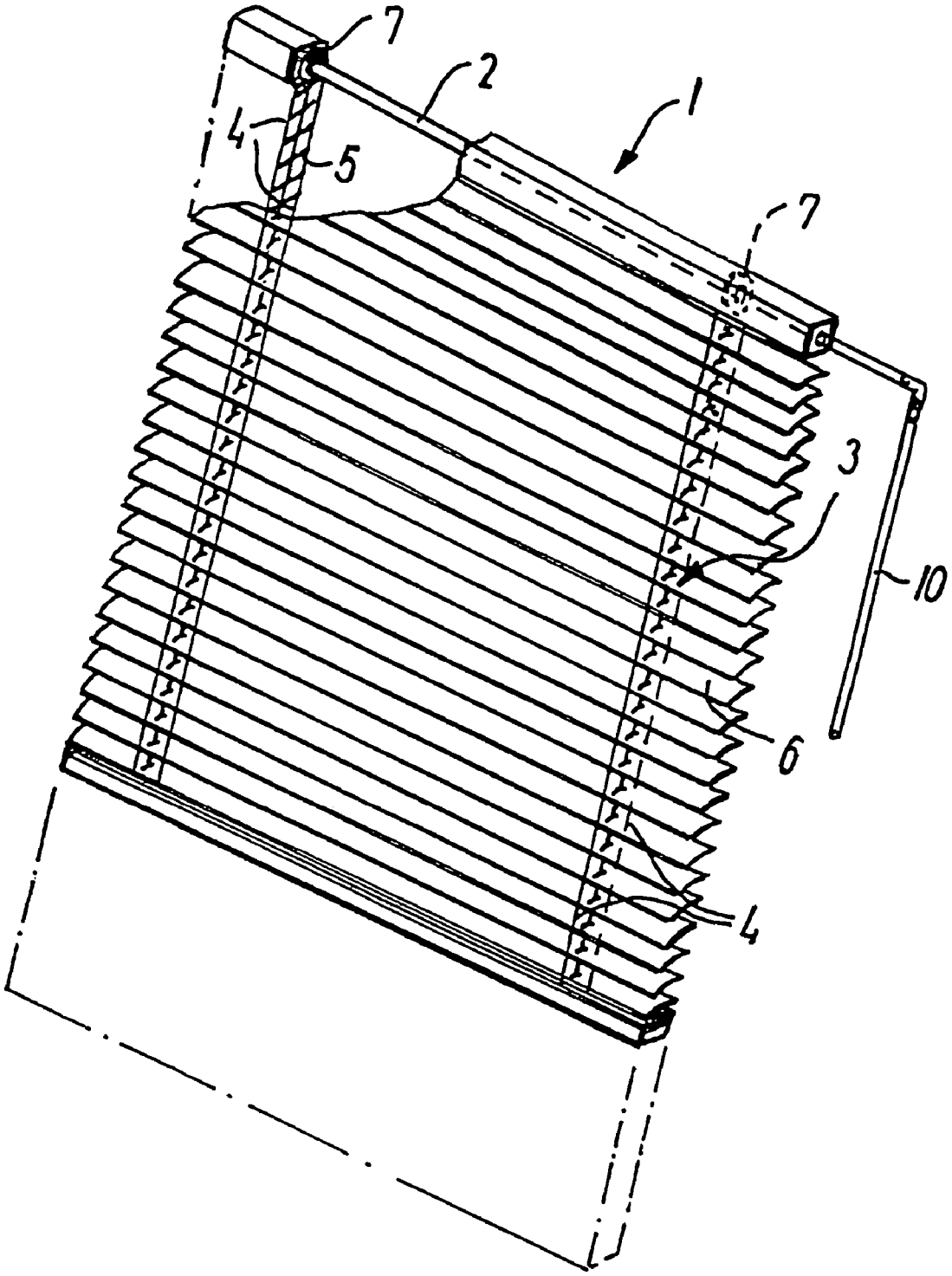

The present application claims the priority under 35 U.S.C. 119 of Danish Patent Application No. PA 2003 00107, filed Jan. 28, 2003, which is hereby incorporated herein by reference in its entirety.

The present invention relates to a Venetian blind comprising at least two vertically expanding ladder members, each ladder member comprising at least a first vertical member placed on a first side of at least one carrier member, and which by a plurality of vertically spaced ladder rungs is connected to at least one other vertical member, which is placed on another, opposite side of the at least one carrier member, a plurality of horizontally arranged cross slats each having a longitudinal axis and each being supported on each of the ladder members by at least one of the ladder rungs between the two vertical members.

Such a Venetian blind is known from CH 429108, wherein said ladder member is carried by the carrier member by means of two vertical members fixed on a fixing device of the carrier member by means of at least one projection and at least one bridge piece. Thus the fixing of the ladder member is done by guiding one of the vertical members of the ladder member over the fixing device, whereupon this vertical member on the other side of the fixing device is fixed to the other vertical member. This implies that one of the vertical members must be of such length that said guiding over the fixing device is possible, and that one of the vertical members must be longer than the other vertical member.

In EP 0098333 A1 both vertical members have been guided over the carrier member from each side of this, the ladder member being fixed on the carrier member by snap fastening of a slotted sleeve over the vertical members and the carrier member. Similar to the previous publication, the vertical members must both be of such length that the guiding over the fixing device is possible.

U.S. Pat. No. 6,279,642 B1 discloses a fixing of the ladder member by mounting balls at the ends of the vertical members, and the balls may then be fixed in a holder on the carrier member.

Usually ladder members are manufactured by cutting an endless ladder member tape. Therefore, subsequent adjustment of the ladder member is necessary in any case in the art, because a certain length of the at least one vertical member is necessary. In CH 429108 and EP 0098333 A1 it is necessary to remove at least the upper ladder rung in order to provide a vertical member having a length by which it is possible to let the carrier member carry the ladder member. Furthermore, in CH 429108 one of the vertical members must be cut after removal of at least the upper ladder rung. In U.S. Pat. No. 6,279,642 B1 the balls at the ends of the vertical members must be mounted after cutting the endless ladder member tape.

These subsequent adjustments are difficult, material-consuming and time-consuming when manufacturing the Venetian blind, in which, aside from said cuttings, a thorough, tolerance sensitive measurement of the threads must be carried out. Assembling the Venetian blind is also difficult and time-consuming because of the complex mounting of the upper part of the ladder member on the fixing device of the carrier member.

The object of the present invention is to present a Venetian blind of the above-mentioned kind, wherein a ladder member provided by cutting an endless ladder member tape, in an easy and uncomplicated way, may be caused to be carried by a carrier member.

With reference hereto, the Venetian blind of the invention is characterized in that each of the at least two ladder members in at least one of their ladder rungs is carried by the at least one carrier member.

The use of at least one of the ladder rungs for fixing of the ladder member implies that, immediately following the provision of the ladder member by cutting an endless ladder member tape, the ladder member may at once be connected to the carrier member, without subsequent adjustment being necessary. In this way, the risk of mismounting, as well as material consumption, manufacturing time and manufacturing costs are reduced. In addition to this, a fixed distance to the ladder rung to carry the upper cross slat is defined, for which reason the Venetian blind of the invention may be used to easily provide a number of homogeneous Venetian blinds.

In a preferred embodiment of the invention, the carrier member comprises at least two fixing devices for fixing a corresponding number of ladder members.

In a further preferred embodiment, the Venetian blind comprises adjustment means for adjustment of the at least one carrier member for adjustment of the tilting of each of the cross slats around the longitudinal axis of the cross slats. In this way it is possible for the user to adjust the passage of light through the blind, while the advantages associated with the easy assembly are maintained.

In a further preferred embodiment the at least two ladder members are fixed on the at least one carrier member, the upper ladder rung of each of the at least two ladder members being fixed on each of the at least two fixing devices. In this way, the ladder member is easily fixed to the carrier member.

In a further preferred embodiment of the invention, each of the upper ladder rungs of the ladder members is fixed in the at least one carrier member by means of a clip snap fastened over the carrier member. In an easy and simple way this provides a durable fixing of the upper ladder rung.

In a further preferred embodiment of the invention, the ladder rung is secured by the clip pressing the upper ladder rung against the carrier member, and preferably the clip is pressing the upper ladder rung against the carrier member in substantially its entire length. Such fixing may easily be carried out, and at low costs.

In yet a further preferred embodiment, the ladder rung exits the clip through gaps so narrow that they prevent the joints between the vertical members and the upper ladder rung from being drawn past the clip. Thus a more durable securing of the upper ladder rung is obtained, without there being a need for great compressive forces on this.

In a further preferred embodiment, along part of the circumference of the carrier member at least one groove exists for receiving at least one of each of the ladder rungs of the ladder members, whereby the at least one ladder rung during mounting may be guided into place in the groove, just as the cross motions of the ladder rung in the fixing device are reduced in the finished product.

In yet a further embodiment, the fixing device consists of moulded plastic, making it possible to produce a high-quality fixing device at low costs.

In a further embodiment, each ladder member is carried in more than one ladder rung, whereby a stronger and more durable connection between the ladder member and the carrier member may be obtained.

In another aspect of the invention, a method for mounting each of the at least two vertically expanding ladder members to the carrier member when mounting a Venetian blind is provided, wherein at least one of each of the ladder rungs of the at least two ladder members is guided over the carrier member, so as to be carried by this. When this method is used for assembling the Venetian blind of the invention, a high-quality Venetian blind is obtained easily and at low costs.

Each of the ladder rungs of the at least two ladder members may at the guiding over the carrier member advantageously be received in the groove of the clip. In this way the ladder rung is secured well to the carrier member.

Figure 2:
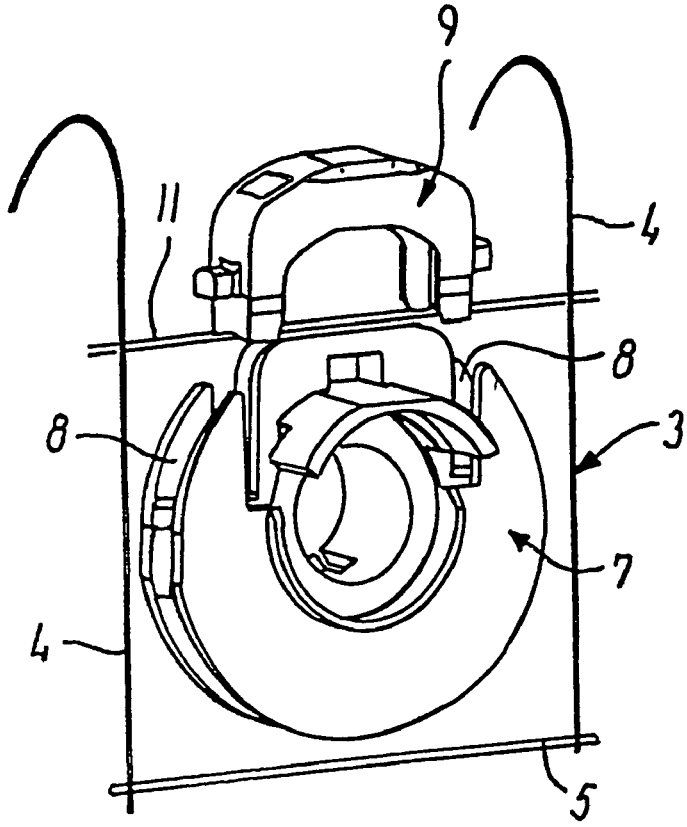
Figure 3:
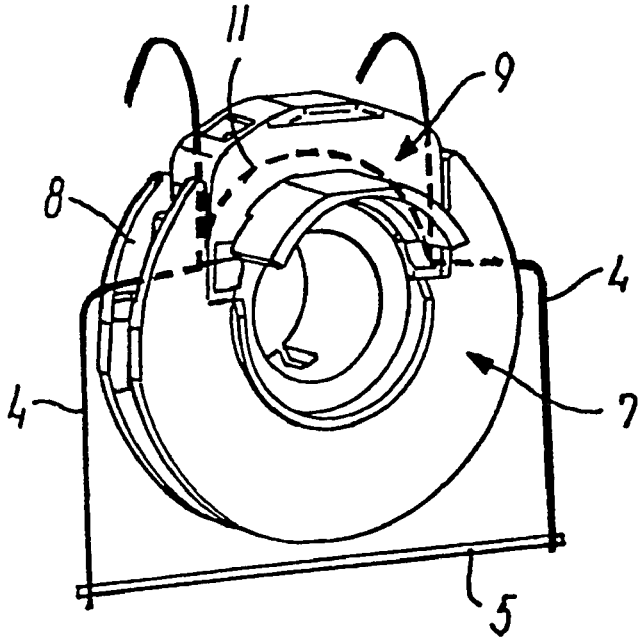

In the following, the invention will be explained in further detail by means of examples of embodiments with reference to the schematic drawing, wherein FIG. 1 shows a perspective view of a Venetian blind;

FIG. 2 shows a detail of the Venetian blind according to FIG. 1 of a fixing device before mounting a clip for the fixing of a ladder cord; and FIG. 3 shows the fixing device according to FIG. 2 after mounting the clip for fixing of the ladder cord.

FIG. 1 is a perspective view of a Venetian blind 1 according to the invention in an assembled condition. The Venetian blind 1 comprises a carrier member in the shape of a crossbar 2, the carrier member of the shown embodiment comprising two fixing devices formed as ladder cord mountings 7, each carrying a ladder member or a ladder cord 3. In the shown embodiment, the ladder cord comprises two vertical members, namely a first and a second vertical cord 4 connected by means of a number of ladder rungs 5, 11. In the shown embodiment according to the invention, each of the ladder rungs 5 are manufactured from two thinner cords in pairs, carrying a number of cross slats 6, thus expanding between the two ladder cords 3. The cross slats 6 may, through the ladder cord mountings 7 and the crossbar 2, be adjusted around the longitudinal axis of the cross slats 6 by means of an adjustment means comprising an adjustment rod 10. When the user turns the adjustment rod 10, the turning movement is transferred to the crossbar 2 making it possible to vary the amount of light passing through the Venetian blind 1. The means for adjustment may also be in the shape of a cord drive, wherein an endless cord is guided over the crossbar 2, the cord, just as the adjustment rod, hanging at the side of the Venetian blind 1. The turning movement of the crossbar 2 is obtained by the user pulling one of the two cords of the cord drive.

FIGS. 2 and 3 illustrate a sectional view of one of the ladder cord mountings 7 before and after mounting, respectively, of the ladder cord 3 on this. The ladder cord 3 is manufactured by cutting an endless ladder cord to a length substantially corresponding to the height of the Venetian blind 1. Then the upper ladder rung 11 of the ladder cord is introduced into the groove 8, whereupon a clip 9 is guided down over the upper ladder rung 11, fixing it to the ladder cord mounting 7, see FIG. 2. The mounting of the clip 9 on the ladder cord mounting 7 may be done manually or mechanically. The fixing of the upper ladder rung 11 is done by each end of the clip 9, after mounting, squeezing down over each end of the upper ladder rung 11. In this way the upper ladder rung 11 is secured by the two ends of the clip 9 and at the same time being held in place in the ladder cord mounting 7, the two joints between the upper ladder rung 11 and the vertical cords 4 not being able to pass through the gaps between the ends of the clip 9 and the ladder cord mounting 7, because the joints are thicker than the upper ladder rung 11.

The Venetian blind of the invention may have other designs than those mentioned. For example, the fixing device of the shown embodiment is manufactured separately from the crossbar; however, it may also be manufactured integral with this. In addition, the carrier member does not necessarily comprise a crossbar, but may, for example, be in two or more pieces. The Venetian blind may be manufactured to be non-adjustable.

Additionally, the fixing of the ladder members of the at least one carrier member may for example also be made by means of a projection and a bridge piece, by means of a slotted sleeve or by means of gluing. The fixing may also be made by one or more ladder rungs hanging on at least one hook, which thus makes up the fixing device(s) of the carrier member.

The word fixing also comprises solutions, wherein the ladder rung is movable in the fixing, for example in a construction as in the shown embodiment, the upper ladder rung, however, not being fastened by the clip, but instead, as described, being secured solely by the joints between the upper ladder rung and the vertical members, because of their thickness not being able to pass through the gap between the ends of the clip and the ladder cord mounting.

The invention claimed is:

1. A Venetian blind comprising at least two vertically extending ladder members, each ladder member comprising at least a first vertical member placed on a first side of at least one carrier member, the first vertical member being connected by a plurality of vertically spaced ladder rungs to at least one other vertical member placed on another, opposite side of the at least one carrier member, a plurality of horizontally arranged cross slats each having a longitudinal axis and each being supported on each of the ladder members by at least one of the ladder rungs between the two vertical members, each of the at least two ladder members being supported by at least one of their ladder rungs, said at least one of the ladder rungs of each of the at least two ladder members being carried by at the least one carrier member, wherein said at least one of the ladder rungs of each of the at least two ladder members is fixed on the at least one carrier member by a clip snap-fastened over the carrier member, and wherein the ladder rung exits the clip through gaps so narrow that the gaps prevent joints between the vertical members and the at least one fixed ladder rung from being drawn past the clip.

2. A Venetian blind according to claim 1, in which the carrier member comprises at least two fixing devices for fixing a corresponding number of ladder members.

3. A Venetian blind according to claim 1, further comprising adjustment means for adjustment of the at least one carrier member for adjustment of the tilting of each of the cross slats around the longitudinal axis of the cross slats.

4. A Venetian blind according to claim 2, in which the at least two ladder members are fixed on the at least one carrier member, the upper ladder rung of each of the at least two ladder members being fixed on a respective one of the at least two fixing devices.

5. A Venetian blind according to claim 1, in which the at least one fixed ladder rung of each of the at least two ladder members is secured by the clip pressing the ladder rung against the carrier member, the clip pressing the at least one fixed upper ladder rung against the carrier member along in substantially the entire length of the ladder rung.

6. A Venetian blind according to claim 1, in which the at least one carrier member comprises a circumference, and along part of the circumference of the at least one carrier member at least one groove exists for receiving said at least one of the ladder rungs of the ladder members.

7. A Venetian blind according to claim 2, in which the fixing devices are manufactured from molded plastic.

8. A Venetian blind according to claim 1, in which each of the ladder members is supported by at least two ladder rungs.

9. A method for mounting vertically extending ladder members to a carrier member when mounting a Venetian blind that includes at least two vertically extending ladder members, each ladder member comprising at least a first vertical member placed on a first side of at least one carrier member, the first vertical member being connected by a plurality of vertically spaced ladder rungs to at least one other vertical member placed on another, opposite side of the at least one carrier member, the Venetian blind further including a plurality of horizontally arranged cross slats each having a longitudinal axis and each being supported on each of the ladder members by at least one of the ladder rungs between the two vertical members, each of the at least two ladder members being supported by at least one of their ladder rungs, said at least one of the ladder rungs of each of the at least two ladder members being carried by the at least one carrier member, wherein the at least one ladder rung of each of the ladder members is fixed on the at least one carrier member by a clip snap-fastened over the carrier member, and wherein the at least one ladder rung exits the clip through gaps so narrow that the gaps prevent joints between the vertical members and the fixed ladder rung from being drawn past the clip, wherein at least one of the ladder rungs of the at least two ladder members is guided over the carrier member so as to be carried by the carrier member.

10. The method according to claim 9, in which the carrier member comprises at least two fixing devices for fixing a corresponding number of ladder members and, when being guided over the carrier member, the at least one ladder rung of the at least two ladder members is received in a groove in one of the fixing devices.

11. A Venetian blind according to claim 1, the Venetian blind further comprising an adjustment device for adjustment of the at least one carrier member for adjustment of the tilting of each of the cross slats around the longitudinal axis of the cross slats.

* * * * *